United States Patent [19]

Swisher et al.

[11] 4,327,319

[45] Apr. 27, 1982

[54] ACTIVE POWER SUPPLY RIPPLE FILTER

[75] Inventors: Scott N. Swisher, Elk Grove, Ill.; Edward L. Furman, Omaha, Nebr.

[73] Assignee: Motorola, Inc., Schaumburg, Ill.

[21] Appl. No.: 178,490

[22] Filed: Aug. 15, 1980

[51] Int. Cl.[3] ..... G05F 5/00

[52] U.S. Cl. ..... 323/303; 323/275

[58] Field of Search ..... 323/275, 281, 299, 303; 363/39, 47

[56] References Cited

U.S. PATENT DOCUMENTS

| | | | |
|---|---|---|---|
| 2,995,697 | 8/1961 | Grenier | 323/303 |
| 3,215,928 | 11/1965 | Aiken | 323/299 |
| 3,868,562 | 2/1975 | Marshall | 320/22 X |
| 3,886,438 | 5/1975 | Bouman | 307/44 X |
| 3,939,399 | 2/1976 | Funatsu et al. | 323/303 X |
| 4,017,779 | 4/1977 | McDonald et al. | 323/303 X |
| 4,048,523 | 9/1977 | Curcio | 307/297 |
| 4,064,448 | 12/1977 | Eatock | 307/297 |
| 4,099,155 | 7/1978 | Watanabe | 340/636 X |
| 4,103,220 | 7/1978 | Huntley | 323/303 |
| 4,114,085 | 9/1978 | Leinonen et al. | 323/280 |
| 4,183,082 | 1/1980 | Ishii | 323/303 X |

*Primary Examiner*—William M. Shoop
*Assistant Examiner*—Peter S. Wong
*Attorney, Agent, or Firm*—James A. Scheer; James W. Gillman

[57] ABSTRACT

An active power supply ripple filter with low noise and low power dissipation characteristics, which tracks the voltage of the power source with low voltage drop and high current capability. The circuit consists of a control transistor connected between one terminal of a power source and one terminal of a load, a reference circuit which tracks the supply voltage, a low pass filter which filters the reference voltage and an amplifier for driving the control transistor in response to the filtered reference voltage and a feedback voltage from the load. The circuit minimizes the voltage drop across the control transistor as well as minimizing the capacitance values required for the filter capacitors.

4 Claims, 2 Drawing Figures

ACTIVE POWER SUPPLY RIPPLE FILTER

BACKGROUND OF THE INVENTION

1. Field of the Invention

The present invention relates to power supply circuitry and, in particular, to a low noise, low voltage drop, active power supply filter suitable for monolithic fabrication.

2. Description of the Prior Art

In conventional communication circuitry it is often desirable to employ a power supply ripple filter which will provide a well filtered, low noise supply voltage capable of high output current and which drops as small a voltage as possible across the filter. Ripple filters known in the prior art do not maintain a minimum voltage drop nor minimal noise levels. Further, prior art circuits require relatively large capacitance values to achieve a desired cut-off frequency and are not highly suitable for monolithic integration.

Accordingly, it is an object of the invention to provide a low noise active power supply ripple filter capable of high output currents while maintaining low voltage drop across the filter.

It is another object of the invention to provide a low noise active power supply ripple filter which minimizes the capacitance values required to achieve desired frequency rejection characteristics.

It is yet another object of the invention to provide a low noise active power supply ripple filter which is particularly suitable for monolithic integration.

Briefly, in accordance with the invention a low noise active power supply filter capable of high output current is provided for eliminating alternating current components from a direct current voltage, with a minimal input-output voltage drop. A control device such as a bipolar transistor is utilized with an input terminal coupled to the power supply and an output terminal coupled to a load. The control device controls and therefore to the power supply the current from the input terminal to the output terminal via a signal coupled to a control terminal. A reference circuit coupled to the input terminal of the control device provides a reference voltage which approximately tracks the power supply input voltage. An amplifier having its output coupled to the control terminal of the control device amplifies a signal applied across first and second input terminals. A filter is coupled to the reference means to low pass filter the reference voltage and then couple the filtered reference voltage to the first input of the amplifier means. A feedback loop couples the control means output terminal to the second input of the amplifier means.

The invention herein disclosed provides a low noise active power supply ripple filter capable of high output current which tracks the direct current supply voltage thereby maintaining a minimum voltage drop across the filter and low power dissipation. The filter also provides some temperature compensation, permits the use of small value filter capacitors and is particularly suitable for monolithic fabrication.

BRIEF DESCRIPTION OF THE DRAWINGS

The features of the present invention which are believed to be novel are set forth with particularity in the appended claims. The invention itself, together with further objects, features and advantages thereof, may best be understood by reference to the following description when taken in conjunction with the accompanying drawings.

DETAILED DESCRIPTION OF THE PREFERRED EMBODIMENT

Figure 1:
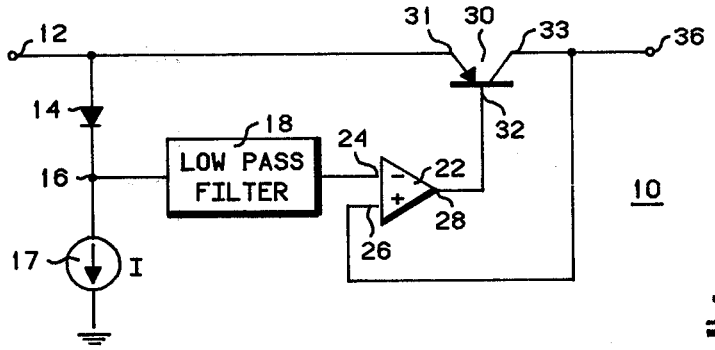
FIG. 1 is a simplified schematic diagram of the novel power supply ripple filter circuit according to the invention.

Referring to FIG. 1, there is shown a simplified schematic diagram of an active power supply ripper filter 10 constructed in accordance with the present invention (and shown with a positive supply of voltages). The output of a DC power supply (not shown) is applied to the active filter input terminal 12. The anode of a diode 14 is coupled to the input terminal 12, as shown, and the cathode of the diode 14 is coupled to a node 16. Also coupled to the node 16 is a current source 17 which is coupled from the node 16 to ground, as shown, to provide a current through the diode 14 when a DC voltage is applied to the input terminal 12. This results in a voltage at the node 16 which is one diode drop (approximately 0.7 volt) below the applied DC voltage. Thus, a reference voltage tracking one diode drop below the input DC voltage is generated at node 16.

The reference node 16 is coupled to the input of a low pass filter 18, which filters the DC reference voltage. A simple RC filter can be used to provide a high degree of filtering, however, multiple pole networks can also be used to provide additional filtering. The output of the low pass filter 18 is coupled, as shown, to the inverting input 24 of a gain stage 22. The output 28 of the gain stage 22 is coupled to the control terminal 32 (i.e., the base) of a control transistor 30. The emitter 31 of the control transistor 30 is coupled, as shown, to the input terminal 12, while the collector 33 of the transistor 30 is coupled to an output terminal 36. Also coupled to the output terminal 36 is the non-inverting input 26 of the gain stage 22, thereby providing negative feedback.

In operation, the circuit of FIG. 1 functions as described below. The output of a DC power supply (not shown), having a small ripple component, is applied to the input terminal 12. This voltage, together with the current source 17, forward biases the diode 14 resulting in a DC reference voltage with ripple at the node 16 which tracks one diode drop below the input DC voltage. This reference voltage is filtered by the low pass filter 18 providing a filtered DC reference to the inverting input 24 of the gain stage 22. The output voltage at the collector 33 of the control transistor 30 is fed back to the non-inverting input 26 of the gain stage 22. Thus, the gain stage 22 acts as a comparator with its output coupled to the base 32 of the control transistor 30, thereby controlling the current through the control transistor 30. If the output voltage at the output terminal 36 drops, the voltage on the noninverting input 26 of the gain stage 22 will drop, causing the difference between the reference voltage at the inverting input 24 and the non-inverting input 26 to increase. This will result in a decrease in the output voltage of the gain stage 22 applied to the base 32 of the control transistor 30, and will drive the control transistor harder, pulling up the output voltage of the output terminal 36.

Since the reference voltage at the inverting input 24 of the gain stage 22 tracks one diode drop below the input voltage, the voltage across the transistor 30 is maintained at approximately one diode drop, independent of the input voltage. This provides the advantage of maintaining a low input-output voltage drop for the circuit, as well as minimizing the power dissipation of the control transistor 30. In addition, the control transistor 30 is kept out of saturation over a wide temperature range. Finally, since the gain stage 22 can have a very low input bias current and good noise characteristics, great flexibility is possible in the choice of the values of resistance and capacitance for the low pass filter 18, while still providing a high degree of supply filtering.

Figure 2:
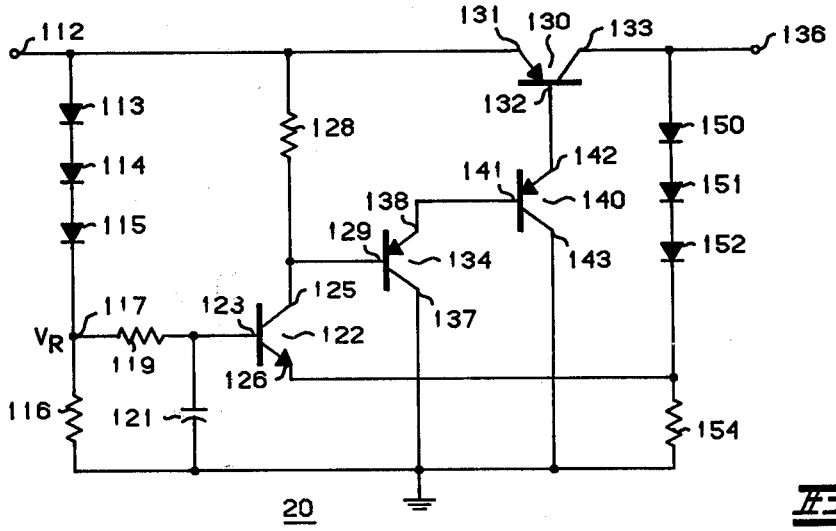
FIG. 2 is a detailed schematic diagram of the preferred embodiment of the novel power supply ripple filter circuit according to the invention.

Referring now to FIG. 2, there is shown a detailed schematic diagram of the preferred embodiment of the novel power supply filter according to the invention. An input terminal 112 is coupled to a reference node 117 via a series string of diodes 113, 114, 115, as shown. The reference node 117 is coupled to ground via a current source resistor 116. The reference node 117 is also coupled to a resistor 119, which is connected to the base 123 of a transistor 122, and to one electrode of a filter capacitor 121. The second electrode of the capacitor 121 is coupled to ground. The emitter 126 of the transistor 122 is coupled to ground via a resistor 154 and the collector 125 is coupled to the input terminal 112 via a resistor 128, as shown. Also coupled to the collector 125 of the transistor 122 is the base 129 of a transistor 134. The collector 137 of the transistor 134 is coupled directly to ground, while the emitter 138 is connected to the base 141 of a transistor 140. The collector 143 of the transistor 140 is connected to the base 132 of a control transistor 130. It can be seen that this arrangement of the transistors 134 and 140 forms a Darlington pair configuration. The emitter 131 of the control transistor 130 is connected to the input terminal 112, and the collector 133 is connected to an output terminal 136, as shown. A series string of three diodes, 150, 151 and 152, are coupled from the output terminal 136 to the resistor 154, as shown, thereby providing a negative feedback connection to the emitter 126 of the transistor 122.

In operation, a DC power supply voltage having a small AC ripple component is applied to the input terminal 112. This DC voltage applied across the series combination composed of the diodes 113, 114, 115 and the resistor 116, will forward bias the diodes 113, 114, 115. This will result in a reference voltage $V_R$ generated at the reference node 117, which tracks three diode drops below the input DC voltage at the input terminal 112. This reference voltage $V_R$ is filtered by the low pass filter formed by the resistor 119 and the capacitor 121. The filtered reference voltage is applied to the base of the transistor 123. The voltage generated at the collector 125 is coupled to the base 132 of the control transistor 130 via the Darlington pair composed of the transistors 134 and 140. The Darlington pair provides a high degree of current gain. Thus, the transistors 122, 134 and 140 form a high gain stage with a high output current capability and an added two diode voltage drop. The reference voltage at the base 123 of the transistor 122 is approximately three diode drops below the input DC voltage. In addition, the feedback through the three diodes 150, 151, 152 will cause the voltage of the emitter 126 of the transistor 122 to be three diode drops below the voltage at the output terminal 136. Therefore, the voltage across the control transistor 130 will be maintained at approximately one diode drop. An additional consequence of the feedback loop is that an output voltage drop will cause the voltage at the emitter 126 to drop, causing the transistor 122 to turn on more. This will drive the transistor 130 harder, pulling up the output voltage at the output terminal 136.

Since this novel active power supply ripple filter tracks the input voltage by maintaining approximately one diode drop across the control transistor 130, it therefore has the dual advantage of low input-output voltage differential and low power dissipation. Also, since the voltage across the reference and feedback diode strings change with temperature in the same manner, the circuit provides the advantage of compensating for temperature changes within the circuit. In addition, since only the base current of the transistor 122 goes through the filter resistor 119, a pinch resistor can be used for the resistor 119 and an NPN transistor can be used for the transistor 122 when the circuit is integrated. A pinch resistor is an integrated circuit resistor with high value of resistance that tracks the NPN beta of the circuit transistors. Thus, a constant voltage drop across the high value resistor can be obtained. This permits the use of a larger value of resistance than could otherwise be utilized, allowing smaller values of capacitance to achieve a desired filter cut-off frequency. Also of importance when integrating this circuit is the fact that no lateral PNP transistor would be required in the signal path since the PNP control transistor 130 is required to be external to the integrated circuit when using standard processing technology due to the high current requirement. In integrated circuits this reduces frequency compensation problems and provides improved noise characteristics over a circuit requiring a lateral PNP in the signal path. Thus, this novel circuit is highly suitable for monolithic integration.

It can be seen from the above description that an active power supply ripple filter has been provided which maintains minimum voltage drop across it and minimum power dissipation in the control device. In addition, the invention provides temperature compensated operation, permits the use of smaller capacitances and is particularly suitable for monolithic fabrication.

While a preferred embodiment of the invention has been described and shown, it should be understood that other variations and modifications may be implemented. It is therefore contemplated to cover by the present application any and all modifications and variations that fall within the true spirit and scope of the basic underlying principles disclosed and claimed herein.

What is claimed is:

1. A low noise electronic power supply filter circuit capable of high output currents for eliminating alternating current components from a direct current power supply and for tracking the direct current voltage of said power supply, comprising:

(a) control means having a control terminal, an input terminal and an output terminal, said input terminal coupled to the power supply and said output terminals adapted to be coupled to a load, said control means controlling current from the input terminal to the output terminal;

(b) reference means, coupled to the control means input terminal for generating a reference voltage which tracks approximately three diode drops below the power supply voltage;

(c) amplifier means having an output coupled to the control terminal and having first and second input terminals, for amplifying a signal applied across the input terminals comprising an input transistor coupled to a darlington pair;

(d) filter means, having an input coupled to the reference means for low pass filtering the reference voltage, and having an output coupled to the first input of the amplifier means thereby coupling the filtered reference voltage to said amplifier means; and (e) feedback means, coupled from the control means output terminal to the second input of the amplifier means, comprising three diodes in series such that approximately one diode drop is maintained across the control means.

2. The low noise electronic power supply filter circuit of claim 1, wherein the control means is a bipolar transistor.

3. The low noise electronic power supply filter circuit of claim 1 fabricated in integrated form wherein the filter means comprises a pinch resistor coupled from the reference means to the amplifier means.

4. The low noise electronic power supply filter circuit of claim 3 wherein the amplifier means comprises an npn input transistor coupled to a pnp darlington pair.

* * * * *